US008389196B2

(12) United States Patent
Yang et al.

(10) Patent No.: US 8,389,196 B2
(45) Date of Patent: Mar. 5, 2013

(54) METHOD OF PREPARING TONER

(75) Inventors: Woo Young Yang, Daejeon (KR); Keon Il Kim, Daejeon (KR); Dae Il Hwang, Daejeon (KR); Il Hyuk Kim, Daejeon (KR); Jae Bum Park, Daejeon (KR); Il Sun Hwang, Daejeon (KR); Jae Kwang Hwang, Daejeon (KR); Dae Woong Choi, Daejeon (KR); Dong Won Kim, Daejeon (KR); Duck Kyun Ahn, Daejeon (KR)

(73) Assignee: Samsung Fine Chemicals Co., Ltd., Ulsan (KR)

( * ) Notice: Subject to any disclaimer, the term of this patent is extended or adjusted under 35 U.S.C. 154(b) by 291 days.

(21) Appl. No.: 12/678,489

(22) PCT Filed: Sep. 19, 2008

(86) PCT No.: PCT/KR2008/005584

§ 371 (c)(1),
(2), (4) Date: Mar. 16, 2010

(87) PCT Pub. No.: WO2009/038404

PCT Pub. Date: Mar. 26, 2009

(65) Prior Publication Data

US 2010/0216069 A1 Aug. 26, 2010

(30) Foreign Application Priority Data

Sep. 21, 2007 (KR) ..... 10-2007-0096804

(51) Int. Cl.
*G03G 9/08* (2006.01)

(52) U.S. Cl. ..... 430/137.19; 430/137.1

(58) Field of Classification Search ..... 430/137.19, 430/137.1

See application file for complete search history.

(56) References Cited

U.S. PATENT DOCUMENTS

| | | | | |
|---|---|---|---|---|
| 5,916,725 | A | 6/1999 | Patel et al. | |
| 6,080,519 | A * | 6/2000 | Ishiyama et al. | 430/110.3 |
| 6,106,990 | A * | 8/2000 | Tazawa et al. | 430/137.19 |
| 6,177,223 | B1 | 1/2001 | Hashimoto et al. | |
| 6,268,103 | B1 | 7/2001 | Hopper et al. | |
| 6,461,783 | B1 * | 10/2002 | Kim et al. | 430/137.1 |
| 2007/0178397 | A1 * | 8/2007 | Yamanouchi et al. | 430/108.4 |

FOREIGN PATENT DOCUMENTS

| | | | |
|---|---|---|---|
| JP | 2003140381 | A | 5/2003 |
| JP | 2003140394 | A | 5/2003 |
| JP | 2006285244 | | 10/2006 |
| KR | 1020020094458 | A | 12/2002 |
| KR | 1020070012260 | A | 1/2007 |
| KR | 1020070092315 | A | 9/2007 |

OTHER PUBLICATIONS

Grant, R. et al., ed., Grant & Hackh's Chemical Dictionary, fifth edition, McGraw-Hill Book Company, NY (1987), p. 132.*

Diamond, A.S., et al., ed., Handbook of Imaging Materials, Second edtion, Marcel Dekker, Inc., NY (2002), p. 187.*

International Search Report, PCT/KR2008/005584, dated Mar. 20, 2009.

* cited by examiner

*Primary Examiner* — Janis L Dote
(74) *Attorney, Agent, or Firm* — Nixon Peabody LLP

(57) ABSTRACT

Provided is a method of preparing a toner, the method including: preparing a solvent emulsion by stirring a medium including a polar medium, an organic solvent, and a surfactant; adding toner components including a resin and a pigment to the solvent emulsion; removing the organic solvent from the solvent emulsion including the toner components; and collecting a toner particle from the solvent emulsion from which the organic solvent is removed.

15 Claims, No Drawings

METHOD OF PREPARING TONER

CROSS-REFERENCE TO RELATED PATENT APPLICATION

This application is a national phase International Application No. PCT/KR2008/005584, entitled, "Method Of Preparing Toner", which was filed on Sep. 19, 2008, and which claims priority of Korean Patent Application No. 10-2007-0096804, filed Sep. 21, 2007, in the Korean Intellectual Property Office.

BACKGROUND OF THE INVENTION

1. Technical Field

The present invention relates to a method of preparing a toner, and more particularly, to a method of preparing a toner, wherein a fixing property and storage stability at a high temperature are simultaneously improved as it is easy to control a structure of the toner.

2. Background Art

Recently, a need for a toner suitable for a high-speed printing, particularly, having a small volume average particle size and a narrow particle size distribution and provides an improved fixing property and storage stability at a high temperature, is increasing in the printing industry.

Generally, a toner is prepared by adding a colorant, a charge control agent, a releasing agent, or the like, to a thermoplastic resin acting as a binder resin. In addition, inorganic or metal fine particles such as silica or a titanium oxide may be added to a toner as external additives in order to provide a toner with fluidity or improve its physical properties such as charge controlling properties or cleaning properties.

The method of preparing such a toner can be categorized into physical and chemical methods.

The physical methods include a pulverization method, which has been widely used. The pulverization method is a method of preparing a toner by obtaining a toner composition by melt-mixing a colorant, charge control agent, and the like, with a binder resin, such as a polyester resin and dispersing the melt-mixture homogenously, and then, pulverizing and classifying the toner composition. The types of resin used in the pulverization method are not limited, but since particles are prepared by pulverizing the resin with a shearing force, huge energy is used, and it is difficult to reduce the sizes of the particles. Also, a particle size distribution is wide since the sizes of the particles are not uniform, and thus, separating out particles having large diameters and small diameters outside a predetermined range should be added so as to improve the resolution of a printed image. Also, when an additive is not uniformly dispersed, the fluidity, developing property, durability, and image quality of the toner may deteriorate. Accordingly, the pulverization method is not suitable for preparing a toner for a high-speed printer.

Meanwhile, the chemical methods include a suspension-polymerization method and an emulsion-aggregation method.

The suspension-polymerization method is disclosed in U.S. Pat. No. 6,177,223, and is a method of preparing a toner by suspension-polymerizing toner materials including binder resin monomers. Particles prepared by using the suspension-polymerization method are spherical in shape, the sizes of the particles can be reduced, and huge energy is not required. However, in the suspension-polymerization method, the types of resin are limited to a vinyl resin that is capable of polymerization in the presence of a radical initiator. Also, polymerization is not completely performed in the suspension-polymerization method. Accordingly, a untreated monomer or solvent may be left in the prepared particles, and thus, penetrate through the surfaces of the particles, thereby deteriorating the physical properties of toner particles and emitting lots of volatile organic compounds (VOC).

The emulsion-aggregation method is disclosed in U.S. Pat. Nos. 5,916,725 and 6,268,103, and is a method of preparing a toner by preparing a micro-emulsion resin particle composition through an emulsion polymerization reaction, and then aggregating the composition with other toner components, e.g. a pigment dispersion and a releasing agent dispersion. According to the emulsion-aggregation method, the shapes of toner particles may vary by adjusting aggregating conditions; for example, the toner particles may have non-spherical shapes. However, since the emulsion-aggregation method also uses emulsion polymerization, only vinyl resins, such as styrene-acrylic copolymers, may be used as binder resins, and preparing of a separate dispersion solution should be further included.

According to such chemical methods, polymerization is performed in a solution, and thus, only vinyl resins may be used as binder resins. However, it is preferable to use polyester resins instead of vinyl resins for a toner for a high-speed printer. That is, the polyester resins are suitable for a high-speed printer or a color printer since the polyester resins have improved pigment dispersibility, excellent transparency, low fixing temperature, and a narrow glass transition temperature range as compared to styrene-acrylic copolymers.

Consequently, a chemical method of preparing a toner using polyester resins has been investigated a lot recently.

For example, JP Patent Nos. 3,640,918 and 3,878,537 disclose a method of preparing toner particles by dissolving toner components in an organic solvent, and then, dispersing the resultant in an aqueous phase including surfactant. According to such a method, the types of a binder resin may be selected freely and the amount of VOC may decrease, but the toner components should be pre-added to the organic solvent, and thus, it is difficult to control a structure of the prepared toner particles.

Accordingly, a method of preparing a toner, wherein a small volume average particle size, a narrow particle size distribution, an improved fixing property, and an improved storage stability at a high temperature are obtained by controlling a structure of a toner, is still required to be developed.

DISCLOSURE OF THE INVENTION

The present invention provides a method of preparing a toner having a small volume average particle size, a narrow particle size distribution, an improved fixing property, and an improved storage stability at a high temperature.

According to an aspect of the present invention, there is provided a method of preparing a toner, the method comprising: preparing a solvent emulsion by stirring a medium comprising a polar medium, an organic solvent, and a surfactant; adding toner components comprising a resin and a pigment to the solvent emulsion; removing the organic solvent from the solvent emulsion comprising the toner components; and collecting a toner particle from the solvent emulsion from which the organic solvent is removed.

BEST MODE FOR CARRYING OUT THE INVENTION

Hereinafter, the present invention will be described more fully with reference to exemplary embodiments of the invention.

Unlike a conventional method of preparing a toner, wherein toner components are first dissolved in an organic solvent and then dispersed in an aqueous phase, the method prepares toner particles by forming a solvent emulsion and then adding toner components in the solvent emulsion and dissolving the toner components in the organic solvent dispersed in the solvent emulsion. By controlling an order of adding the toner components, it is easy to control a structure of the toner. Accordingly, a toner having a small volume average particle size, a narrow particle size distribution, an improved fixing property, and an improved storage stability at a high temperature is prepared. Also, it is easy to adjust toner surface charges by selectively using the pigment in a form of a master batch and encapsulating the pigment.

A method of preparing a toner according to an embodiment of the present invention includes: preparing a solvent emulsion by stirring a medium including a polar medium, an organic solvent, and a surfactant; adding toner components including a resin and a pigment to the solvent emulsion; removing the organic solvent from the solvent emulsion including the toner components; and collecting toner particles from the solvent emulsion from which the organic solvent is removed.

In detail, a medium including a polar medium, an organic solvent, and a surfactant is added to a reactor, and then the reactor is stirred so as to prepare a solvent emulsion in which the organic solvent is dispersed in the polar medium. Then, toner components including a resin, a pigment, a releasing agent, and a charge control agent are added to the solvent emulsion. Here, the toner components selectively penetrate into the dispersed organic solvent according to a solubility difference, thereby obtaining a particulate emulsion. Then, the particulate emulsion including the toner components is heated so as to remove the organic solvent, and cooled down to room temperature. Then, toner particles are collected from the particulate emulsion, cleaned and dried so as to obtain dried toner particles.

In the current embodiment, the solubility of the toner components with respect to the organic solvent may be higher than that with respect to the polar medium, and moreover, the toner components may be insoluble in the polar medium. In other words, the polar medium is a non-solvent to the toner components. According to such a solubility difference, the toner components selectively penetrate into the organic solvent.

In the method, the organic solvent may have a lower boiling point than the polar medium. Accordingly, it is possible to selectively remove the organic solvent from the particulate emulsion.

The organic solvent may be removed from the particulate emulsion by increasing temperature, reducing pressure, or simultaneously increasing temperature and reducing pressure, but the method of removing the organic solvent from the particulate emulsion is not limited thereto as long as the organic solvent is selectively removed from the particulate emulsion.

In detail, the organic solvent may have a boiling point that is at least 15° C. lower than that of the polar medium. In other words, a difference between the boiling points of the organic solvent and the polar medium may be at least 15° C. regardless of pressure.

Accordingly, when the organic solvent is removed at a normal pressure while increasing temperature, a range of increasing temperature may be between 60 and 95° C. When the temperature is below 60° C., the vaporization of the organic solvent is insufficient, and when the temperature exceeds 95° C., the vaporization of the polar medium will be too much.

The polar medium used in the method may be one of water; glycerol; glycols such as 1,3-propylene glycol, diethylene glycol, dipropylene glycol, 1,3-butylene glycol, and 1,2-propylene glycol; polyhydric alcohols such as 1,3-propanediol, 1,4-butanediol, sorbitol, polyvinyl alcohol, and a copolymer thereof; and a mixture thereof, but the polar medium is not limited thereto as long as the polar medium is immiscible with the organic solvent. Also, the polar medium may be water.

The organic solvent used in the method lowers a viscosity of the resin when the toner particles are prepared, so that the toner particles are easily formed. The organic solvent may be one of methyl acetate, ethyl acetate, isopropyl acetate, methyl ethyl ketone, dimethyl ether, diethyl ether, 1,1-dichloroethane, 1,2-dichloroethane, dichloromethane, chloroform, and a mixture thereof, but organic solvent is not limited thereto as long as the organic solvent is immiscible with the polar medium and has lower boiling point than that of the polar medium.

In the method, the toner components may be simultaneously or sequentially added to the solvent emulsion. The order of an addition of the toner components, such as the resin and the pigment, may be changed according to situations. For example, the toner components may be added simultaneously or sequentially. A structure of the toner changes according to such an order of adding the toner components, and thus, it is convenient to control the structure of the toner.

For example, when a pigment having a polar functional group exists mainly around a surface of the toner, the charging speed and charging quantity of a toner are reduced. However, in the method according to the current embodiment, by adding the toner components in an order of the pigment and then the resin, the pigment mainly exists inside the toner, thereby changing the structure of the toner.

A form of the toner components added to the solvent emulsion is not limited, and the toner components may be added after being pulverized to a micro resin powder form, or added after being dissolved in an auxiliary solvent.

When the toner components are added to the solvent emulsion after being dissolved in an auxiliary solvent, the auxiliary solvent may be methyl acetate, ethyl acetate, isopropyl acetate, methyl ethyl ketone, dimethyl ether, diethyl ether, 1,1-dichloroethane, 1,2-dichloroethane, dichloromethane or chloroform.

The resin used in the method may be a polyester resin, a styrene copolymer resin, an epoxy resin, or a mixture thereof, but the resin is not limited thereto as long as the resin is used in a related technical field.

The resin may include a water dispersible functional group. The water dispersible functional group may be a metal salt form of at least one functional group selected from the group consisting of a hydroxyl group, a mercapto group, a carboxyl group, a phosphate group, a sulfonic acid group, and a sulfate group, for example, sodium sulfonate or sodium carboxylate.

The polyester resin may have a weight average molecular weight between 6,000 and 100,000, a Mw/Mn value, i.e., a polydispersity index (PDI), between 2 and 15, a Mz/Mw of resin between 3 and 20, an acid value between approximately 2 and 20 mg KOH/g, the content of dicarboxylic residue including a sodium sulfonate anion group is approximately between 0.05 and 0.5 mol % with respect to the total amount of dicarboxylic residue, and THF insoluble content between 40 and 0.01 wt %. Here, THF insoluble content may be between 20 and 0.01 wt %, preferably, between 10 and 0.01 wt %.

The pigment may be suitably selected from a cyan pigment, a magenta pigment, a yellow pigment, a black pigment, a white pigment, and a mixture thereof, considering hue, saturation, lightness, weatherability, transparency, and compatibility of the pigment with a toner resin.

The black pigment may be a black pigment, such as SB4, SB7, or SB9, titanium oxide or carbon black. The cyan pigment may be a copper phthalocyanine compound and derivatives thereof, an anthraquine compound, or a base dye lake compound. Specifically, the cyan pigment may be C.I. pigment blue 1, 7, 15, 15:1, 15:2, 15:3, 15:4, 60, 62, 66, or the like. The magenta pigment may be a condensed nitrogen compound, anthraquine, a quinacridone compound, a base dye lake compound, a naphthol compound, a benzo imidazole compound, a thioindigo compound, or a perylene compound. Specifically, the magenta compound may be C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, or the like. The yellow pigment may be a condensed nitrogen compound, an isoindolinone compound, an anthraquine compound, an azo metal complex, or an allyl imide compound. Specifically, the yellow pigment may be C.I. pigment yellow 12, 13, 14, 17, 62, 74, 83, 93, 94, 95, 109, 110, 111, 128, 129, 147, 168, or the like. Such pigments are suitably selected considering color coordinates and density of colors.

When an excessive amount of the pigment is added, the elasticity of a resin composition may be high, and thus the toner particles may be difficult to be formed and a particle size distribution may broaden. Alternatively, when the amount of the pigment added is low, a coloring scale of the toner may be low, and thus, coloring expression may be insufficient while printing an image. Accordingly, the content of the pigment may be between 2 and 15 wt %, preferably, between 4 and 12 wt % with respect to the total weight of the toner.

The pigment may be used as it is, but may be used in a form of a master batch in which pigment is dispersed within the resin. By using pigment in the form of a master batch, the pigment is suppressed from being exposed to a surface of a toner particle, thereby increasing a charge capability of the toner particles.

The master batch means a resin composition wherein pigment is uniformly dispersed in high concentration, and is prepared by blending the pigment and the resin under high temperature and high pressure, or by adding the pigment to the resin solution and applying a high shearing force to disperse the pigment. When the master batch is prepared by the latter method, the solvent should be removed before using a prepared toner. In the master batch, the pigments are evenly dispersed compared to simple mixing. Specifically, when the master batch is dispersed in a medium, the master batch is pulverized to very small sizes, but the resin used in the master batch does not completely dissolve in the solvent. In other words, even when particle sizes of the master batch are decreased, the surfaces of the particles of the pigment are covered by the resin.

Generally, when polar groups existing in a pigment expose on the surface of toner particles, they have a function to discharge charges accumulated in a toner, and as a result, charging speed and charging quantity of the toner decrease. However, when the master batch is used, the pigment is evenly dispersed inside the polyester resin, and thus the pigment is not directly exposed on the surface of the toner. In other words, the pigment particles are encapsulated by the polyester resin, and thus, charges of the toner are conveniently adjusted.

The content of the pigment in the master batch may be between 10 and 60 wt %, and preferably, 20 and 40 wt %.

The toner components may further include an additive, such as a releasing agent, a charge control agent, or an external additive.

The releasing agent is an additive that can improve a fixing property of the toner, and may be ester wax, carnauba wax, polyethylene wax, polypropylene wax, beeswax, paraffin wax, or a mixture thereof. When the content of the releasing agent is too low, it is difficult to fix toner particles without using oil, and when the content of the releasing agent is excessive, toner particles may cluster together when stored for long.

The content of the releasing agent included in the toner components may be between 0.1 and 30 wt %, and preferably, between 1 and 10 wt %.

The charge control agent may be suitably selected based on charges to be granted to the final toner, and may be a positive charge control agent, a negative charge control agent, or a mixture thereof.

The positive charge control agent is largely classified into an azine type and quaternary ammonium salt type, according to a chemical structure of the positive charge control agent. The azine type positive charge control agent is mainly black, and thus is used only when preparing a black toner. However, the quaternary ammonium salt type positive charge control agent is white powder, and thus may be used in preparing any toner color. A tert-butyl salicylate metal salt type white charge control agent and an azo type black charge control agent are largely used as the negative charge control agent, according to a chemical structure of the charge control agent. Chromium, aluminum, zinc, calcium, boron, acetyl boron, or the like is used as a center metal of the tert-butyl salicylate metal salt type white charge control agent, and chromium, iron, or the like is mainly used as a metal in the azo type black charge control agent. The charging speed and charging quantity are adjusted by adding the metal salt in the toner.

When the content of the charge control agent is low, the charging speed decreases and the charging quantity may be small. When the content of the charge control agent is high, the number of charges may increase, thereby distorting an image. Accordingly, the content of the charge control agent may be between 0.1 and 8 wt % based on the total amount of the toner, and preferably, between 0.3 and 5 wt % based on the total amount of the toner.

In the method of preparing a toner, according to the current embodiment of the present invention, when the toner components further include a releasing agent, a charge control agent, an external additive, etc, aside from the resin and the pigment, the toner components are added to the solvent emulsion in an order of the resin and the releasing agent, or in an order of the releasing agent and the resin. Alternatively, the pigment and the charge control agent may be simultaneously added to the solvent emulsion with the resin or sequentially added after the resin is added.

In the current embodiment, the medium, including the polar medium, the organic solvent, and the surfactant, may further include a thickener.

The thickener dissolves in the polar medium, may be added within the range of 0.01 to 5 parts by weight based on 100 parts by weight of the polar medium, and may be added within the range of 0.1 to 10 parts by weight based on 100 parts by weight of the binder resin. In detail, the thickener may be polyvinylpyrrolidone, polyvinylpyrrolidone cationic copolymer, polyvinylpyrrolidone anionic copolymer, polyvinyl alcohol, polyvinyl alcohol copolymer, polyacrylic acid, polyacrylic acid copolymer, gelatin, chitosan, sodium alginate, alginic acid, agar, or a mixture thereof.

The surfactant may be at least one surfactant selected from the group consisting of an anionic surfactant, a nonionic surfactant, an amphoteric surfactant, a cationic surfactant, and a mixture thereof, and is not limited thereto as long as a hydrophilic-lipophilic balance (HLB) value is equal to or above 10.

In detail, the surfactant may be sodium stearoyl lactylate, polyethylene glycol cocamine, polyethylene glycol sorbitan hexanoate, polyethylene glycol dilaurate, steamine acetate, tallow amine acetate, glyceryl stearate, polyethylene glycol lanolate, polyethylene glycol palmitate, polypropylene glycol dilaurate, tallow amine acetate, glyceryl stearate, polyethylene glycol lanolate, polyethylene glycol palmitate, polyethylene glycol hydroxyethyl cocamine, polyethylene glycol glyceryl laurate, polyethylene glycol stearate, triethylamine oleate, polyethylene glycol tallow amine, sucrose laurate, sodium dodecyl sulfate, potassium dodecyl sulfate, alkyl ammonium chloride, alkyl ammonium bromide, or a mixture thereof.

The toner components may further include higher fatty acid, fatty acid amide, or a metal salt thereof. The higher fatty acid, the fatty acid amide, or the metal salt thereof is suitably used to obtain a high quality image by preventing deterioration of various developing properties.

The toner components may further include the external additive, such as a fluidizing agent, having very small organic or inorganic particles, by coating surfaces of the toner particles with the additive.

The external additive increases the fluidity of particles to be used as the toner or adjusts the charging properties, such as charging quantity and charging speed. The external additive may be minutely classified hydrophobic silica particles; hydrophilic silica particles; silica particles having their surfaces coated with a conductive material, such as strontium, calcium, or the like; silica particles having their surfaces coated with antimony tin oxide, indium-tin-oxide which is a semiconductor, or the like; titanium oxide particles; titanium oxide particles having their surfaces coated with a conductive material, such as strontium, calcium, or the like; titanium oxide particles having their surfaces coated with antimony tin oxide, indium-tin-oxide which is a semiconductor, or the like; zinc stearate particles; magnesium stearate particles; alumina particles; polymethyl methacylate particles; polystyrene particles; or silicon particles.

The toner particle obtained by the method according to the current embodiment may have a volume average particle size between 2.0 and 8.0 μm, and an 80% span value equal to or below 0.88, and preferably, equal to or below 0.80.

When the 80% span value exceeds 0.9, a non-uniformity of the toner particle diameters causes deterioration of charge properties or contamination in a printer. Accordingly, in order to use such a toner particle, an additional process of classifying toner particles having sizes being out of a predetermined range should be performed.

A circularity of the toner particle may be in a range of 0.95 to 0.99.

The toner prepared by the method according to the current embodiment of the present invention may additionally include carriers (solid carrier particles). The carriers have a structure wherein a magnetic material is coated with an insulating material, and in detail, the carriers may be ferrite covered with an insulating material, magnetite coated with an insulating material, iron power coated with an insulating material, or a mixture thereof.

The toner particles may have various shapes, like non-spherical shapes, even when the same shearing force is physically applied to a toner composition according to the types of the surfactant, the polar medium, the organic solvent, the assistance solvent, and/or the thickener, and also, the toner particles may have various shapes by changing a temperature of removing the organic solvent. For example, non-spherical toner particles may be prepared by changing the composition of the organic solvent by adding an auxiliary solvent. The non-spherical toner particles easily resolve malfunction problems of a printer during a cleaning operation.

Hereinafter, the present invention is described more in detail with reference to the following examples that are for illustrative purposes only and are not intended to limit the scope of the present invention.

Terminologies used and various physical properties of a resin, toner particles, etc., obtained in the following examples and preparation examples are measured via the following methods unless separately defined.

Measuring Volume Average Particle Size

A volume average particle size is measured by using a Coulter Multisizer (Coulter Electronics Co., Ltd.; St. Petersburg, Fla.). In the Coulter Multisizer, an aperture was 100 μm, and a sample was manufactured by adding a suitable amount of surfactant in 50~100 ml of ISOTON-II (manufactured by Beckman Coulter) that is an electrolyte, adding 10~15 mg of a sample thereto, and then dispersing the resultant in an ultrasonic disperser for 1 min.

Volume Average Particle Size (L)

A volume average particle size is a terminology defined in pages 3 through 13 of the Powder Technology Handbook (K. Gotoh et al., 2nd Edition, Marcell Dekker Publications, 1997).

Measuring 80% Span Value

An 80% span value is an index defining a particle size distribution. Here, d10 denotes particle size corresponding to 10% of the volumes, i.e., corresponding to 10% of the total volume when volumes are accumulated from small particles by measuring particle sizes, d50 denotes particle size corresponding to 50%, and d90 denotes particle size corresponding to 90%. Values of d10, d50, and d90 are obtained from a particle size distribution chart, and then, an 80% span value is obtained by using Equation 1 below.

$$\text{80\% Span Value} = (d90 - d10)/d50 \quad \text{(Equation 1)}$$

Here, when the 80% span value is small, a particle size distribution is narrow, and when the 80% span value is high, the particle size distribution is wide.

Measuring Circularity

Circularity was measured by using an FPIA-3000 (manufactured by Sysmex in Japan). While measuring the circularity by using the FPIA-3000, a sample was manufactured by adding a suitable amount of surfactant to 50~100 ml of distilled water, adding 10~20 mg of toner particles thereto, and then dispersing the resultant in an ultrasonic disperser for 1 min.

The circularity is automatically obtained by the FPIA-3000 according to Equation 2 below.

$$\text{Circularity} = \frac{2\sqrt{\text{area} \times \pi}}{\text{perimeter}} \quad \text{(Equation 2)}$$

Here, area denotes a projected area of a toner, and perimeter denotes a perimeter of a circle having the same area as the projected area of the toner. A value of the circularity may be between 0 and 1, and when the value is near to 1, a toner particle is more circular.

Measuring Glass Transition Temperature (Tg, ° C.)

A glass transition temperature was measured by heating a sample from 20° C. to 200° C. at a rate of 10° C./min., rapidly cooling the sample to 10° C. at a rate of 20° C./min., and then, increasing the temperature of the sample at a rate of 10° C./min by using a Differential Scanning Calorimeter (DSC) (Model STA 409 manufactured by Netzsch).

Measuring Acid Value

An acid value (mg KOH/g) was measured by dissolving a resin in dichloromethane, cooling the resultant, and then, titrating the cooled resultant with a 0.1N KOH methyl alcohol solution.

Measuring Charging Quantity

Charging quantity was measured by using a Vertex Charge Analyzer 150 (manufactured by Vertex Image Products in Yukon, Pa.), which is a blow-off type electric charge measuring apparatus.

In a blow-off method, a mixture of a pulverized body and a carrier is put into a cylindrical container having both ends blocked by a net. The pulverized body and the carrier are separated from each other by infusing high-pressure gas through one of the ends, and then only the pulverized body is blown off from meshes of the net. Here, charging quantity that is equivalent to and has an opposite polarity as charging quantity of the pulverized body blown off from the cylindrical container is left in the carrier. Also, by a faraday cage, the entire electric flux generated by the charging quantity gathers in a condenser, and thus the condenser is charged. The charge amount (Q) of the pulverized body is measured by measuring a potential of the both ends of the condenser and a capacity of the condenser, as defined in the following Equation 3.

$$Q=CV \quad \text{(Equation 3)}$$

Here, C denotes capacity of the condenser, V denotes a voltage of both ends of the condenser, and Q denotes charging quantity of the pulverized body.

A charging speed is measured by dividing charging quantity generated between a carrier and a toner particle while mixing the carrier and the toner particle by a time taken to mix the carrier and the toner particle. An initial charging speed means a speed that a charging quantity is formed on a toner particle. In embodiments of the present invention, an initial charging speed is calculated by charging quantity measured after 1 minute is passed after mixing a carrier and a toner particle.

Synthesis of Polyester Resin Having Water Dispersible Functional Group

Preparation Example 1

Synthesis of polyester resin 1

A 3 L reactor equipped with a stirrer, a thermometer, and a condenser was installed in an oil bath. 0.5 mol of dimethyl terephthalate, 0.495 mol of dimethyl isophthalate, 0.005 mol of dimethyl 5-sulfo isophthalate sodium salt, 2.3 mol of 1,2-propylene glycol, and 0.02 mol of trimellitic acid were each added to the reactor. Then, tetrabutyl titanate was added thereto as a polymerization catalyst at a ratio of 500 ppm with respect to the total weight of the monomers. Then, the temperature of the reactor was increased to 150 t while stirring the mixture at a speed of 100 rpm. The reaction was performed for about 5 hours. When methanol, which is a byproduct of an esterification reaction, was no more obtained from a condenser, and the reaction was additionally performed for 15 hours at an elevated reaction temperature of 220° C. under reduced pressure of 0.1 torr.

The glass transition temperature (Tg) of the polyester resin 1 was measured as 65° C. using a DSC. When the polyester resin 1 was dissolved in THF, insoluble gel fraction was 8 wt % with respect to the total amount of polyester. Also, the acid value was 5 mg KOH/g, and the number average molecular weight of the polyester resin 1 was measured as 4,500 using a gel permeation chromatography (GPC) using polystyrene as a standard sample, the PDI of the polyester resin 1 was 3.5, the z-average molecular weight of the polyester resin 1 was 120,000. In the polyester resin 1, the content of dicarboxylic residue including a sodium sulfonate anionic group was 0.3 mol % with respect to the total amount of carboxylic residues.

Preparation of Pigment Master Batch

Preparation Example 2

Preparation of cyan pigment master batch 1

The polyester resin 1 synthesized in Preparation Example 1 and a blue pigment (C.I. pigment blue 15:3, color index (CI) no. 74160, manufactured by DIC) were mixed at a weight ratio of 6:4. Then, ethyl acetate was added to the resulting mixture in the ratio of 50 parts by weight of ethyl acetate to 100 parts by weight of the polyester resin 1, and the mixture was heated to about 60° C. and stirred and mixed in a kneader. Then, while the mixture was mixed at a rate of 50 rpm using a biaxial extruder connected to a vacuum device, ethyl acetate, as a solvent, was removed using the vacuum device to obtain a cyan pigment master batch 1.

Preparation of Substantially Circular Toner Particles

Example 1

Preparation of Cyan Toner Particles 400 g of distilled water, 10 g of polyvinyl alcohol (P-24, manufactured by DC Chemical Co. in Seoul, Korea), 7 g of neutral surfactant (Tween 20, manufactured by Aldrich Chemical Company in Milwaukee, Wis.), and 4.2 g of sodium dodecylsulfate (manufactured by Junsei Chemical Company in Tokyo, Japan), as an anionic surfactant, were added to a pressurizable 1 L reactor equipped with a condenser, a thermometer, and a impeller stirrer, and then, solids were completely melted by stirring the mixture at a rate of 500 rpm at 70° C. so as to obtain an aqueous solution. Then, a soft white solvent emulsion was obtained by mixing 100 g of methyl ethyl ketone (manufactured by Aldrich Chemical Company in Milwaukee, Wis.) in the aqueous solution.

Then, 85 g of the polyester resin 1 synthesized in Preparation Example 1, 5 g of carnauba wax (SX-70, manufactured by MAX chemical in Daejeon, Korea), 15 g of the cyan pigment master batch 1 prepared in Preparation Example 2, and 2 g of a charge control agent (N-23, manufactured by HB Dinglong in Hubei, China) were sequentially added to the reactor in the order stated. Here, the polyester resin 1 was pulverized to about 1 mm for use.

Then, an emulsion was obtained by heating the mixture in the reactor at 72° C. in a refluxed state and stirring the mixture for 3 hours at a rate of 1,000 rpm. After the stirring, it was checked that the emulsion was stable as the resin in the bottom of the reactor was completely dissolved.

Then, the stirring speed of the emulsion was decreased to 300 rpm, and methyl ethyl ketone, as an organic solvent, was removed from the emulsion while heating the reactor at 90° C. under partially reduced pressure of 100 mmHg.

After 4 hours, the amount of removed methyl ethyl ketone was measured to check that the methyl ethyl ketone was completely removed, and then the emulsion was cooled down to 25° C.

Then, toner particles were separated from the emulsion by using a conventional filter. A cleaning process of removing a surfactant and a thickener included in a filter cake was repeated by redispersing the filter cake in the distilled water and then re-filtering the distilled water 4 times.

The re-filtered toner particles were dried in a vacuum oven at 40° C. for one day, and thus dried toner particles were obtained.

The obtained toner particles had 87.9 wt % of polyester resin, 5.6 wt % of pigment, 4.6 wt % of carnauba wax, and 1.9 wt % of the charge control agent.

Example 2

Preparation of Cyan Toner Particles

Toner particles were prepared in the same manner as Example 1, except that an order of adding polyester resin 1, carnauba wax, cyan pigment master batch 1, and a charge control agent to the reactor was changed to carnauba wax, polyester resin 1, cyan pigment master batch 1, and the charge control agent.

As a result of analyzing the toner particles, the obtained toner particles had 87.9 wt % of polyester resin, 5.6 wt % of pigment, 4.6 wt % of carnauba wax, and 1.9 wt % of the charge control agent.

Example 3

Preparation of Cyan Toner Particles

Toner particles were prepared in the same manner as Example 2, except that 6 g of blue pigment (C.I. pigment blue 15:3, CI no. 74160, manufactured by DIC) was used instead of 15 g of cyan pigment master batch 1 prepared in Preparation Example 2, and 94 g of polyester resin 1 was used instead of 85 g of polyester resin 1 considering the amount of polyester resin 1 in the cyan pigment master batch 1.

Preparation of Toner Particles that are Substantially Non-Circular

Example 4

Preparation of Cyan Toner Particles

Toner particles were prepared in the same manner as Example 1, except that a mixture of 360 g of distilled water and 40 g of 1,3-butylene glycol was used instead of 400 g of distilled water.

When the toner particles were observed by using a scanning electron microscope, the toner particles had slightly drooping shapes.

Comparative Example 1

Preparation of Cyan Toner Particles 400 g of distilled water, 10 g of polyvinyl alcohol (P-24, manufactured by DC Chemical Co, in Seoul, Korea), 7 g of neutral surfactant (Tween 20, manufactured by Aldrich Chemical Company in Milwaukee, Wis.), and 4.2 g of sodium dodecylsulfate (manufactured by Junsei Chemical Company in Tokyo, Japan), as anionic surfactant, are added to a pressurizable 1 L reactor 1 equipped with a condenser, a thermometer, and an impeller stirrer, and then solids were completely dissolved by stirring the mixture at a rate of 500 rpm at 70.

300 g of methyl ethyl ketone (manufactured by Aldrich Chemical Company in Milwaukee, Wis.) was added to a reactor 2, and then 5 g of carnauba wax (SX-70, manufactured by MAX Chemical in Daejeon, Korea), 94 g of polyester resin 1 prepared in Preparation Example 1, 6 g of blue pigment (CI pigment blue 15:3, CI no. 74160, manufactured by DIC in Japan), 2 g of charge control agent (N-23, manufactured by HB Dinglong in Hubei, China) were all added to the reactor 2. Then, the reactor 2 was heated to about 65 so as to dissolve and disperse the content in the reactor 2. Here, the polyester resin was pulverized to about 1 mm for use.

The content in the reactor 2 was added to the reactor 1 while stirring the content at a rate of 200 rpm, and then, a mixture was formed by stirring the content in reactor 1 at a rate of 1,000 rpm. Then, the mixture was heated at 72° C. in a refluxed state and stirred for 3 hours so as to obtain an emulsion. After the stirring, it was checked that the emulsion was stable as resins at the bottom of the reactor 1 were completely dissolved.

Then, the stirring speed of the emulsion was decreased to 300 rpm, and methyl ethyl ketone, as an organic solvent, was removed by heating the reactor 1 at 90° C. under partially reduced pressure of 100 mmHg.

After 4 hours, the amount of removed methyl ethyl ketone was checked so as to check that all methyl ethyl ketone was removed, and then the emulsion was cooled down to 25° C.

Then, toner particles were separated from the emulsion by using a conventional filter. A cleaning process of completely removing a surfactant and a thickener included in a filter cake was repeated by redistributing the filter cake in distilled water and re-filtering the distilled water 4 times.

The re-filtered toner particles were dried in a vacuum oven at 40° C. for one day so as to obtain dried toner particles.

Physical properties of the toner particles prepared in Examples 1 through 4 and Comparative Example 1 were evaluated via above methods.

Measuring Volume Average Particle Size, 80% Span Value and Circularity of Toner Particles Results of measuring a volume average particle size, an 80% span value, and circularity of the cyan toner particles in Examples 1 through 4 and Comparative Example 1 are shown in Table 1 below.

TABLE 1

| Toner Particles | Volume average particle size | 80% Span Value | Circularity |
|---|---|---|---|
| Example 1 | 6.7 μm | 0.55 | 0.982 |
| Example 2 | 7.1 μm | 0.65 | 0.987 |
| Example 3 | 7.4 μm | 0.69 | 0.985 |
| Example 4 | 6.9 μm | 0.63 | 0.975 |
| Comparative Example 1 | 8.2 μm | 0.89 | 0.990 |

As shown in Table 1, the toner particles in Examples 1 through 4 have smaller volume average particle sizes and narrower particle size distributions as compared to the toner particles in Comparative Example 1.

Also, the amount of methyl ethyl ketone used in Example 1 is 100 g, and the amount of methyl ethyl ketone used in Comparative Example 1 is 300 g, and thus it can be seen that the method of preparing a toner according to embodiments of the present invention can remarkably reduce the amount of organic solvent, as compared to conventional technology.

In addition, as shown in Example 4, composition of the solvent is changed, for example, by adding an auxiliary solvent, and thus, substantially non-spherical toner particles are easily prepared.

Measuring Charging Quantity of Toner Particles after External Addition 100 parts by weight of the toner particles prepared in Examples 1 through 3 and Comparative Example 1 are each mixed with 1 part by weight of silica (TG 810G, manufactured by Cabot) for 15 minutes in a roll mill so as to prepare toner particles including an external additive. Charging quantity of the toner particles, including the external additive, was measured using a blow-off method.

The results of measuring the charging quantity are shown in Table 2 below.

TABLE 2

| Toner Particles | Initial Charging speed | Charging quantity |
|---|---|---|
| Example 1 | −15 μC/min | −29 μC/gram |
| Example 2 | −19 μC/min | −31 μC/gram |
| Example 3 | −13 μC/min | −26 μC/gram |
| Comparative Example 1 | −8.2 μC/min | −10 μC/gram |

As shown in Table 2, the initial charging speed and the charging quantity of Examples 1 and 2 using the cyan pigment master batch 1 are reduced less than those of Example 3 and Comparative Example 1 that do not use the cyan pigment master batch 1. Accordingly, it can be seen that a surface charge is conveniently adjusted by using a master batch.

As shown in Table 2, the master batch prevents the pigment from being separated from the toner particles. As a result, an additional process of removing the pigment separated from the toner particles while preparing a toner can be omitted.

Evaluating Storage Stability at High Temperature 9.75 g of toner particles prepared in Examples 1 through 3 and Comparative Example 1, 0.2 g of silica (TG 810G, manufactured by Cabot), and 0.05 g of silica (RX50, manufactured by Degussa) are added to a 25 ml glass bottle, and the mixture was left for 72 hours under a temperature/moisture condition of 50° C./80%. Then, the storage stability at a high temperature was evaluated by visually observing the resultant. The results of evaluation are shown in Table 3 below, with √, ○, Δ, and X symbols. Each symbol has following meanings √: No flocculation, thus no problem.

○: Weak flocculation, but flocculated toner particles are scattered when shaking, and no problem in use.

Δ: Weak flocculation, but flocculated toner particles are not easily scattered when shaking, and slight problem in use.

X: Strong flocculation, flocculated toner particles are not scattered, and having problem in use.

Evaluating Fixing Temperature Range 9.75 g of toner particles prepared in Examples 1 through 3 and Comparative Example 1, 0.2 g of silica (TG 810G, manufactured by Cabot), and 0.05 g of silica (RX50, manufactured by Degussa) were mixed to prepare a toner with external additives. Using the toner with external additives, unfixed solid images of 30 mm×40 mm were prepared by a Samsung CLP-510 printer. Then, the fixing properties of the unfixed images were evaluated by changing a temperature of a fixing roller in a fixing test device that is manufactured to arbitrarily change a fixing temperature. Also, a wide fixing temperature range denotes an excellent fixing property. The results of the evaluation are shown in Table 3 below.

TABLE 3

| Toner Particles | Storage Stability at High Temperature | Range of Fixing Temperature ( ) |
|---|---|---|
| Example 1 | ○ | 150~210 |
| Example 2 | ✓ | 150~210 |
| Example 3 | ✓ | 150~210 |
| Comparative Example 1 | X | 150~190 |

As shown in Table 3, the toner particles in Examples 1 through 3 have improved fixing properties and improved storage stability at a high temperature as compared to the toner particles in Comparative Example 1.

In the fixing properties, it can be seen that the fixing temperature ranges of the toner particles of Examples 1 through 3 are widened as a hot offset temperature is increased to about 20° C. as compared to the fixing temperature range of the toner particles of Comparative Example 1. Accordingly, even when a contacting time of the toner particles and a fixing roller at a high temperature increases, the possibility of contamination that occurs as the toner particles adhere to the fixing roller decreases in Examples 1 through 3 as compared to Comparative Example 1.

The toner particles of Examples 2 and 3, where wax is mainly distributed inside the toner particles, had the most excellent storage stability at a high temperature, and the toner particles of Comparative Example 1, where wax is unevenly distributed in the toner particles, had the most deteriorated storage stability at a high temperature.

As a result, the method of the present invention can prepare a toner having a small volume average particle size, a narrow particle size distribution, an improved fixing property, and an improved storage stability at a high temperature, as compared to conventional technology. Also, toner surface charges are conveniently adjusted by selectively using pigments in a form of a master batch and encapsulating pigments.

While the present invention has been particularly shown and described with reference to exemplary embodiments thereof, it will be understood by one of ordinary skill in the art that various changes in form and details may be made therein without departing from the spirit and scope of the present invention as defined by the following claims.

The invention claimed is:

1. A method of preparing a toner, the method comprising:

preparing a solvent emulsion by stirring a medium comprising a polar medium, an organic solvent, and a surfactant, wherein the polar medium is a non-solvent to the toner components and the organic solvent is immiscible with the polar medium, and has a boiling point lower than the polar medium;

adding toner components comprising a resin and a pigment to the solvent emulsion, wherein the resin comprises a water dispersible functional group;

removing the organic solvent from the solvent emulsion comprising the toner components; and collecting a toner particle from the solvent emulsion from which the organic solvent is removed.

2. The method of claim 1, wherein the polar medium is at least one selected from the group consisting of water; glycerol; 1,3-propylene glycol, diethylene glycol, dipropylene glycol, 1,3-butylene glycol, 1,2-propylene glycol, 1,3-propanediol, 1,4-butanediol, sorbitol, polyvinyl alcohol and a polyvinyl alcohol copolymer.

3. The method of claim 1, wherein the polar medium is water.

4. The method of claim 1, wherein the organic solvent is at least one solvent selected from the group consisting of methyl acetate, ethyl acetate, isopropyl acetate, methyl ethyl ketone, dimethyl ether, diethyl ether, 1,1-dichloroethane, 1,2-dichloroethane, dichloromethane, chloroform, and a mixture thereof.

5. The method of claim 1, wherein the toner components are simultaneously or sequentially added to the solvent emulsion.

6. The method of claim 1, wherein the resin comprises at least one resin selected from the group consisting of polyester resin, styrene copolymer resin and epoxy resin.

7. The method of claim 1, wherein the water dispersible functional group comprises a metal salt form of at least one functional group selected from the group consisting of a hydroxyl group, a mercapto group, a carboxyl group, a phosphate group, a sulfonic acid group, and a sulfate group.

8. The method of claim 1, wherein the pigment is added to the solvent emulsion in a form of master batch wherein the pigment is dispersed in the resin.

9. The method of claim 8, wherein the pigment is added to the master batch in a range from 10 to 60 weight % with respect to the total weight of the master batch.

10. The method of claim 1, wherein the toner component further comprises at least one additive selected from the group consisting of a releasing agent, a charge control agent, and an external additive.

11. The method of claim 10, wherein when the toner components further comprise a releasing agent, the toner components are added to the solvent emulsion in an order of the resin and the releasing agent.

12. The method of claim 10, wherein when the toner components further comprise a releasing agent, the toner components are added to the solvent emulsion in an order of the releasing agent and the resin.

13. The method of claim 10, wherein when the toner components further comprise a charge control agent, the pigment and the charge control agent of the toner components, are simultaneously added to the solvent emulsion with the resin or sequentially added to the solvent emulsion after the resin.

14. The method of claim 1, wherein an average volume diameter of the toner particle is between 2.0 and 8.0 μm, and a 80% span value of the toner particle is equal to or below 0.88.

15. The method of claim 1, wherein a circularity of the toner particle is in a range between 0.95 and 0.99.

* * * * *

UNITED STATES PATENT AND TRADEMARK OFFICE

CERTIFICATE OF CORRECTION

PATENT NO. : 8,389,196 B2
APPLICATION NO. : 12/678489
DATED : March 5, 2013
INVENTOR(S) : Yang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 292 days.

Signed and Sealed this
First Day of September, 2015

Michelle K. Lee

Michelle K. Lee
*Director of the United States Patent and Trademark Office*